US005680892A

United States Patent [19]

Liu

[11] Patent Number: 5,680,892

[45] Date of Patent: Oct. 28, 1997

[54] SLAT ANGLE ADJUSTING DEVICE FOR A VENETIAN BLIND

[76] Inventor: Tai-ping Liu, No. 15, Alley 8, Lane 3, Kuochi St., Lungching Hsiang, Taichung Hsien, Taiwan

[21] Appl. No.: 690,518

[22] Filed: Jul. 31, 1996

[51] Int. Cl.[6] ..... E06B 9/38

[52] U.S. Cl. ..... 160/177 R

[58] Field of Search ..... 160/166.1 R, 168.1 R, 160/168.1 V, 172 R, 173 R, 170 R, 171 R, 176.1 R, 176.1 V, 177 R, 177 V, 178.1 R, 115, 107, 178.1 V

[56] References Cited

U.S. PATENT DOCUMENTS

| | | | |
|---|---|---|---|
| 3,156,295 | 11/1964 | Vecchiarelli et al. | 160/177 R X |
| 3,333,905 | 8/1967 | Hennequin | 160/177 R X |
| 4,245,687 | 1/1981 | Vecchiarelli | 160/177 R |
| 4,333,510 | 6/1982 | Fox | 160/177 R |
| 4,406,319 | 9/1983 | McNiel et al. | 160/177 R |
| 4,522,245 | 6/1985 | Anderson | 160/177 R |
| 4,541,468 | 9/1985 | Anderson | 160/177 R |
| 4,676,292 | 6/1987 | Valle et al. | 160/177 R X |

*Primary Examiner*—David M. Purol
*Attorney, Agent, or Firm*—Heller Ehrman White & McAuliffe

[57] ABSTRACT

A slat angle adjusting device is provided for a Venetian blind includes a headrail substantially U-shaped in section with two side walls each having an upper bent portion extending inwardly and downwardly therefrom. The adjusting device includes a body received in the headrail, a positioning member fixedly mounted on an upperside of the body and having two C-shaped forked ends each securely mounted on a corresponding one of the two upper bent portions of the headrail, and a roller rotatably mounted in the headrail and attached to and located outside of the body.

6 Claims, 4 Drawing Sheets

SLAT ANGLE ADJUSTING DEVICE FOR A VENETIAN BLIND

FIELD OF THE INVENTION

The present invention relates to an angle adjusting device, and more particularly to a slat angle adjusting device for a Venetian blind.

BACKGROUND OF THE INVENTION

A conventional slat angle adjusting device for a Venetian blind is shown in FIG. 4, however, there still remain shortcomings therein. There will be a complete illustration in the detailed description of the preferred embodiments, concerning the conventional adjusting device.

The present invention has arisen to mitigate and/or obviate the disadvantage of the conventional device.

SUMMARY OF THE INVENTION

In accordance with one aspect of the present invention, there is provided a slat angle adjusting device for a Venetian blind comprising a headrail substantially U-shaped in section with two side walls each having an upper bent portion extending inwardly and downwardly therefrom.

The adjusting device comprises a body received in the headrail, a positioning member fixedly mounted on an upperside of the body and having two C-shaped forked ends each securely mounted on a corresponding one of the two upper bent portions of the headrail, and a roller rotatably mounted in the headrail and attached to and located outside of the body.

Further features of the present invention will become apparent from a careful reading of the detailed description provided hereinbelow, with appropriate reference to the accompanying drawings.

DETAILED DESCRIPTION OF THE PREFERRED EMBODIMENTS

Figure 4:
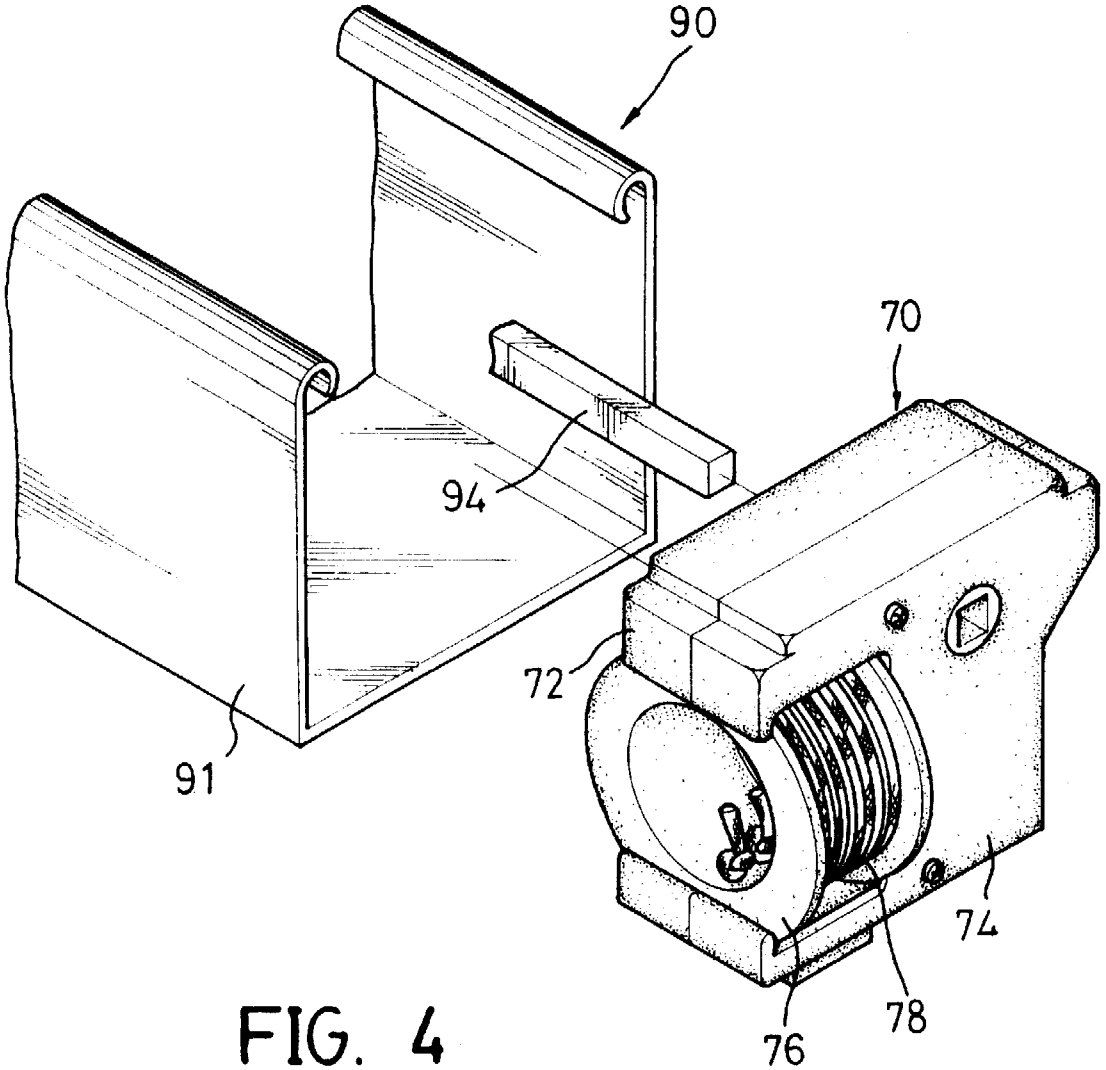
FIG. 4 PRIOR ART
FIG. 4 is an exploded view of a conventional slat angle adjusting device for a Venetian blind in accordance with the prior art.

For a better understanding of the present invention, reference is made to FIG. 4 illustrating a conventional slat angle adjusting device for a Venetian blind 90 in accordance with the prior art.

The conventional slat angle adjusting device comprises a body 70 including two casings 72 and 74 coupled together with each other and received in a substantially U-shaped headrail 91 of the Venetian blind 90.

A tilt rod 94 is disposed in the headrail 91 and extends through the body 70. A pinion (not shown) is rotatably received in the body 70 and is fixedly mounted around the tilt rod 94.

A worm (not shown) located beneath the pinion is rotatably mounted in the body 70 and meshes with the pinion. A drive shaft (not shown) is fixedly mounted in the worm. A pulley 76 is rotatably received in the body 70 and is fixedly mounted around one end the drive shaft. A tilt cord 78 winds around the pulley 76 and has two distal ends extending downwardly.

In operation, a user can exert a drawing force on either of the two distal ends of the tilt cord 78, thereby rotating the pulley 76 which can drive the drive shaft to rotate the worm which can in turn rotate the pinion so as to rotate the tilt rod 94, thereby adjusting a rotational angle of a plurality of slats (not shown) of the Venetian blind 90.

By such an arrangement, however, the body 70 is not stably and securely mounted in the headrail 91 such that the body 70 easily becomes loosened in the headrail 91 during long-term utilization.

In addition, the headrail 91 may be required to have a long length such that two side walls (not numbered) of the headrail 91 tend to deform inwardly relative to each other. As a result, the body 70 is not easy to be fitted into the headrail 91, thereby easily causing an inconvenience during installation.

Further, the pulley 76 together with the tilt cord 78 is fitted in the body 70 such that the body 70 has to be dismantled so as to adjust the tilt cord 78 if being tangled when the body 70 is detached from the headrail 91, thereby greatly causing difficulty in maintenance.

Figure 1:
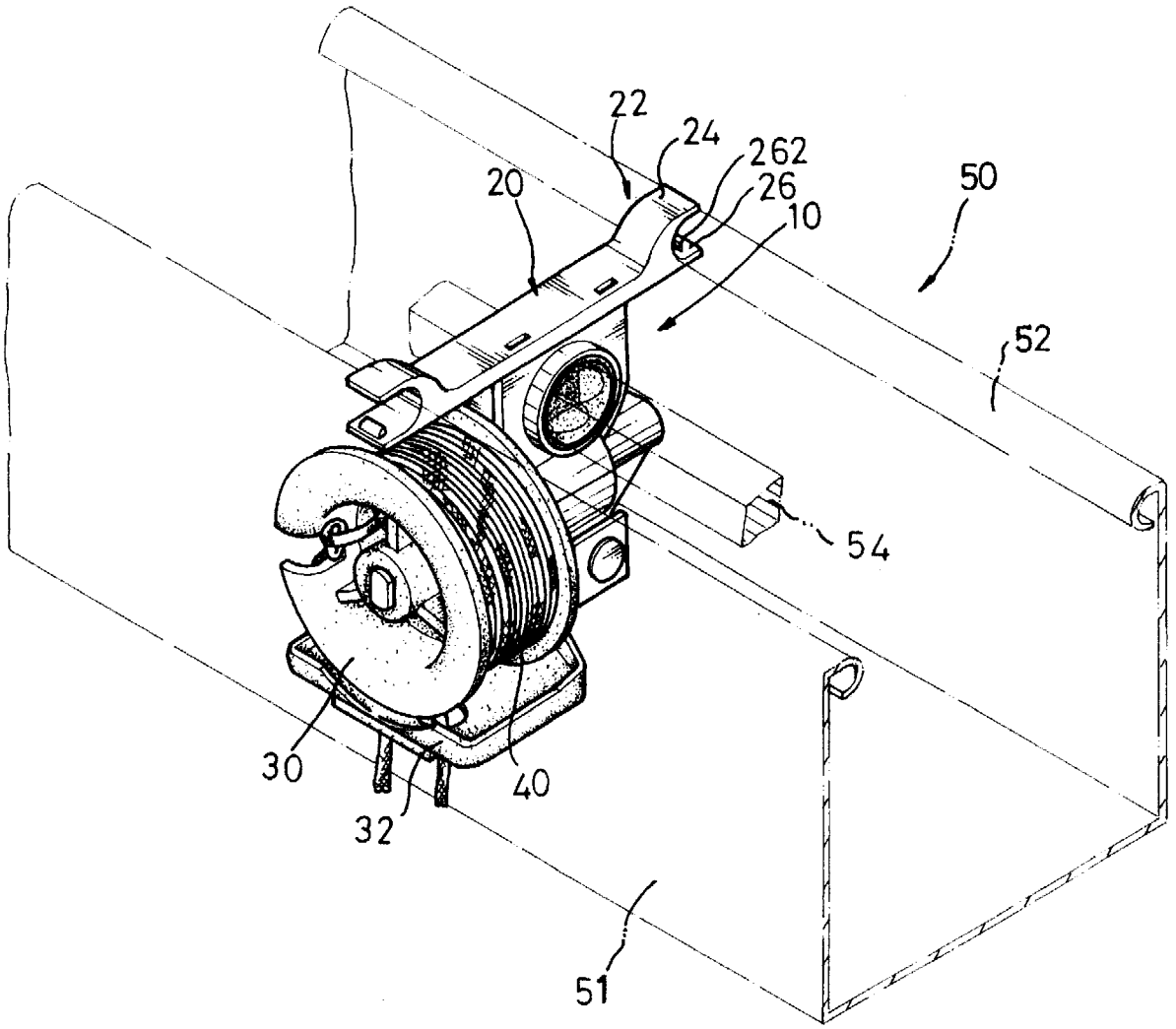
FIG. 1 is a perspective view of a slat angle adjusting device for a Venetian blind in accordance with the present invention.
Figure 2:
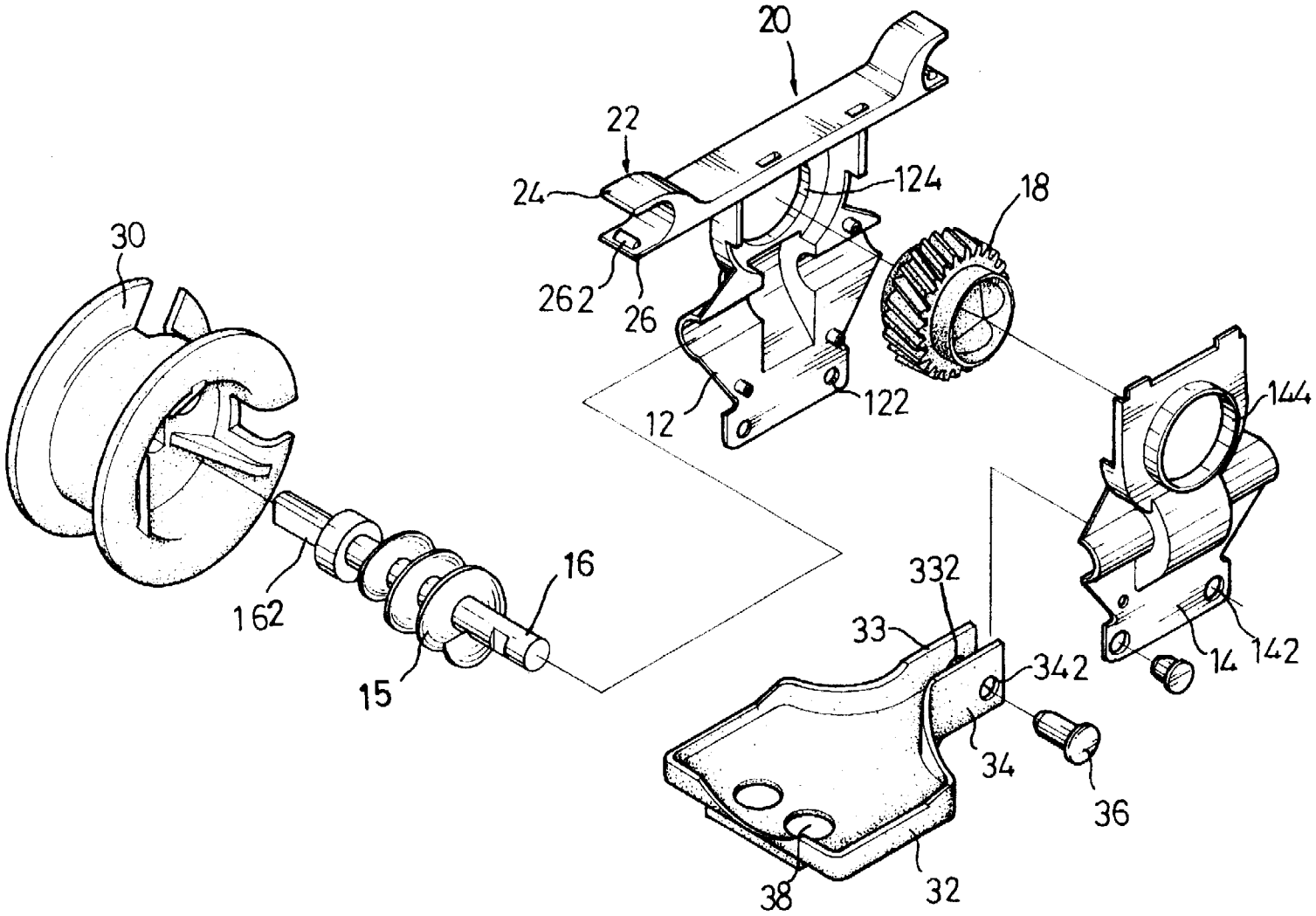
FIG. 2 is an exploded view of FIG. 1.
Figure 3:
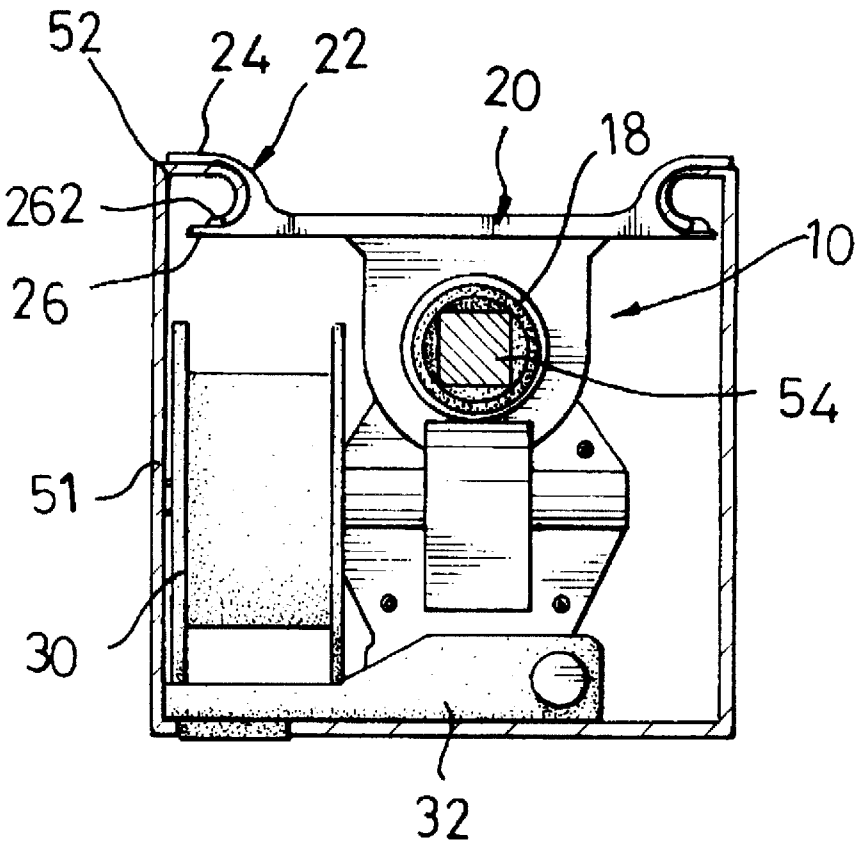
FIG. 3 is a front plan partially cross-sectional view of FIG. 1.

Referring to FIGS. 1–3, a slat angle adjusting device in accordance with the present invention is provided for adjusting a rotational angle of a plurality of slats (not shown) of a Venetian blind 50 which includes a headrail 51 substantially U-shaped in section with two side walls each having an upper bent portion 52 extending inwardly and downwardly therefrom.

The adjusting device comprises a body 10 received in the headrail 51, a positioning member 20 fixedly mounted on an upperside of the body 10 and having two C-shaped forked ends 22 each securely mounted on a corresponding one of the two upper bent portions 52 of the headrail 51, and a roller 30 rotatably mounted in the headrail 51 and attached to and located outside of the body 10.

The body 10 preferably comprises a first casing 12 and a second casing 14 coupled together with each other.

The positioning member 20 is fixedly mounted on an upperside of the first casing 12. It is appreciated that the positioning member 20 also can be fixedly mounted on an upperside of the second casing 14.

Especially referring to FIG. 3, each of the two C-shaped forked ends 22 of the positioning member 20 includes an upper tongue 24 rested on an upper edge of the associated upper bent portion 52, a lower tongue 26 rested on a lower edge of the upper bent portion 52, and a catch 262 formed on the lower tongue 26 and securely urged on the lower edge of the upper bent portion 52.

A pinion 18 is rotatably mounted in the body 10 and has a first side received in a first opening 124 defined in the first casing 12 and a second side received in a second opening 144 defined in the second casing 14. A tilt rod 54 is fixedly mounted in and rotated by the pinion 18 and extends along the headrail 51 longitudinally for adjusting a rotational angle of the plurality of slats of the Venetian blind 50.

A worm 15 located under the pinion 18 is rotatably mounted in the body 10 and meshes with the pinion 18. A drive axle 16 is integrally formed at one end of the worm 15 and includes one distal end 162 extending outward of the body 10 and fixedly mounted in and rotated by the roller 30.

A base bracket 32 is received in the headrail 51 and has a first end portion pivotally mounted on an underside of the body 10 and a second end portion located beneath the roller 30.

A first ear 33 and a second ear 34 are formed on the first end portion of the base bracket 32 and are each mounted on an outer wall of the first and second casings 12 and 14 respectively.

A pin 36 extends sequentially through a hole 342 defined in the second ear 34, a bore 142 defined in the second casing 14, a hole 332 defined in the first ear 33 and a bore 122 defined in the first casing 12, thereby attaching the first end portion of the base bracket 32 to the first and second casings 12 and 14.

The base bracket 32 has two spaced holes 38 vertically defined in the second end portion thereof and located under the roller 30. A tilt cord 40 winds around the roller 30 and has two distal ends each extending downwardly through a corresponding one of the two spaced holes 38 of the base bracket 32.

In operation, a user can exert a pulling force on one distal end of the tilt cord 40, thereby rotating the roller 30 which can force the drive axle 16 to rotate the worm 15 which is able to rotate the pinion 18 so as to rotate the tilt rod 54, thereby adjusting a rotational angle of the plurality of slats of the Venetian blind 50.

By such an arrangement, the slat angle adjusting device can be stably and securely positioned in the headrail 51 by means of a clamping engagement between each of the two C-shaped forked ends 22 of the positioning member 20 and the associated upper bent portion 52 of the headrail 51.

In addition, the roller 30 is disposed outside of the body 10 and the base bracket 32 is pivotally attached to the body 10 such that the tilt cord 40 can be easily recovered, if it has become tangled, by detaching the adjusting device from the headrail 51 without there being a need to dismantle the body 10.

It should be clear to those skilled in the art that further embodiments of the present invention may be made without departing from the scope and spirit of the present invention.

What is claimed is:

1. A slat angle adjusting device for a Venetian blind comprising a headrail substantially U-shaped in section with two side walls each having an upper bent portion extending inwardly and downwardly therefrom, said adjusting device comprising:

a body received in said headrail;

a positioning member fixedly mounted on an upperside of said body and having two C-shaped forked ends each securely mounted on a corresponding one of said two upper bent portions of said headrail, each of said two C-shaped forked ends including an upper tongue rested on an upper edge of an associated said upper bent portion, a lower tongue rested on a lower edge of associated said upper bent portion, and a catch formed on said lower tongue and securely urged on the lower edge of associated said upper bent portion; and a roller rotatably mounted in said headrail and attached to and located outside of said body.

2. The slat angle adjusting device in accordance with claim 1, wherein said body comprises a first casing and a second casing coupled together with each other.

3. The slat angle adjusting device in accordance with claim 2, wherein said positioning member is fixedly mounted on an upperside of said first casing.

4. The slat angle adjusting device in accordance with claim 2, wherein said positioning member is fixedly mounted on an upperside of said second casing.

5. The slat angle adjusting device in accordance with claim 1, further comprising a base bracket received in said headrail and having a first end portion pivotally mounted on an underside of said body and a second end portion located beneath said roller.

6. The slat angle adjusting device in accordance with claim 5, wherein said base bracket has two spaced holes vertically defined in the second end portion thereof and located under said roller.

* * * * *